United States Patent [19]

Larson

[11] Patent Number: 4,578,969

[45] Date of Patent: Apr. 1, 1986

[54] TUMBLER LOCK HAVING PERIPHERAL KEY

[75] Inventor: Wayne F. Larson, Salem, Oreg.

[73] Assignee: Supra Products, Inc., Salem, Oreg.

[21] Appl. No.: 673,933

[22] Filed: Nov. 26, 1984

[51] Int. Cl.[4] ..... E05B 29/02

[52] U.S. Cl. ..... 70/366; 70/407; 70/409

[58] Field of Search ..... 70/362, 365, 366, 407, 70/408, 409

[56] References Cited

U.S. PATENT DOCUMENTS

| | | | |
|---|---|---|---|
| 688,070 | 12/1901 | Denn | 70/366 |
| 1,553,639 | 9/1925 | Sherman | 70/408 |
| 1,915,897 | 6/1933 | Maxwell | 70/407 |
| 2,578,211 | 12/1951 | Spain | 70/366 |
| 3,334,501 | 8/1967 | Greenwald | 70/408 |
| 3,821,886 | 7/1974 | Ladewig | 70/366 |
| 4,407,147 | 10/1983 | Larsen | 70/365 |

FOREIGN PATENT DOCUMENTS

| | | | |
|---|---|---|---|
| 417594 | 9/1974 | U.S.S.R. | 70/366 |

*Primary Examiner*—Robert L. Wolfe
*Attorney, Agent, or Firm*—Klarquist, Sparkman, Campbell, Leigh & Whinston

[57] ABSTRACT

A peripheral key for a tumbler lock, the key being transversely curved concentrically with the axis of the lock, and having an L-shaped groove to pass a sentry lug on a lock. The L-shaped groove has a longitudinal leg opening longitudinally at the free end of the lock, and a lateral leg communicating with the inboard end of the longitudinal leg and opening laterally to enable the sentry lug to pass along and out of the L-shaped groove to free the key for further operative movement. A tumbler lock having code discs and actuating discs, and a pusher plate having a lost-motion connection with a mounting plug to pick up the plug after predetermined movement of a curved peripheral key. A key as first described above, together with a lock having a sentry lug for accommodating insertion of the key into the lock. A lock and peripheral curved key wherein the key has concentric inner and outer surfaces engaging mating curved surfaces on a lock housing and central internal components to maintain the key in a longitudinal position while being used.

10 Claims, 12 Drawing Figures

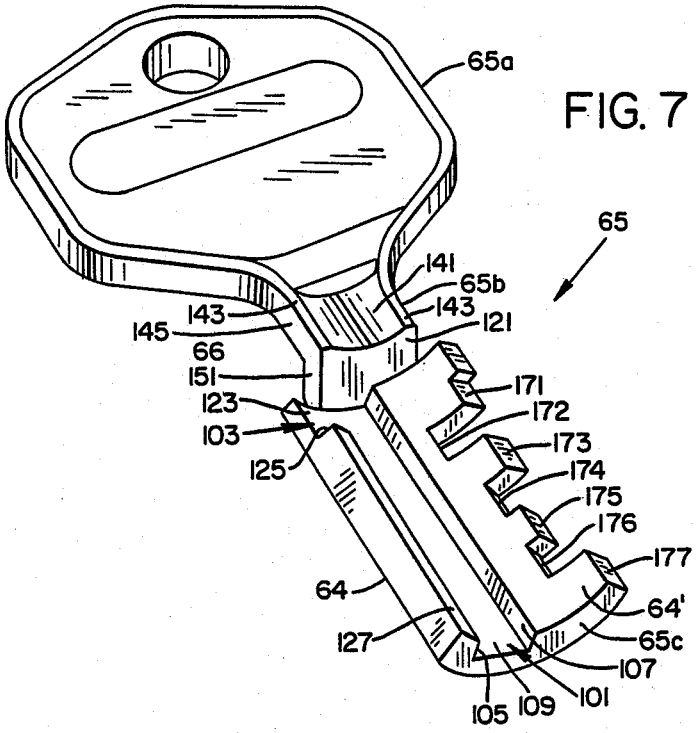
FIG. 7
FIG. 8
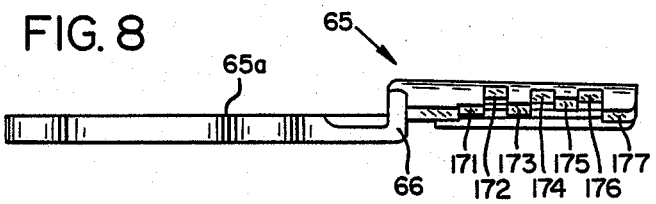
FIG. 9
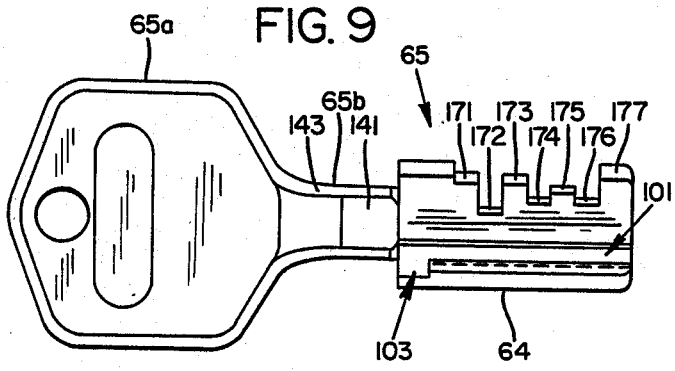
FIG. 10
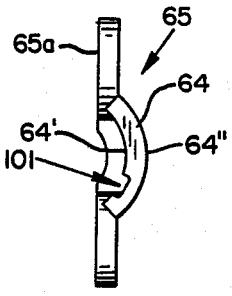

TUMBLER LOCK HAVING PERIPHERAL KEY

This invention relates to tumbler locks and keys therefor, and particularly relates to a two stage tumbler lock and a related key.

My prior U.S. Pat. No. 4,407,147 entitled "PERIPHERAL KEY TUMBLER LOCK" issued Oct. 4, 1983, concerns a lock and a peripheral key of this type.

The present invention relates to improvements in both the key and the lock of my patented design.

Apart from these general aims, it is important in certain fields of usage to provide a key that cannot be readily copied by locksmiths. It is of course easy to produce a complicated key, but since it must not only fit into but effect the desired operations of the lock, there is a danger of making the overall combination so complicated and expensive as to be unacceptable in the marketplace.

It is thus an important specific object of the present invention to provide a key for a lock of the type under consideration that will not only be difficult to duplicate by a locksmith, but does not unduly complicate the construction of the lock itself.

The key of my patented lock is designed for peripheral rather than axial insertion and usage. The key of the present invention is similarly designed, but it differs from the patented key in several important respects. The latter has a long keyway which dead-ends inboard, and slidably receives a longitudinally extending keying lug on an anti-pick pusher plate. Also, the pusher plate in the preferred patented form of the invention is cut away exteriorly to provide a wide groove to slidably receive the key. Thus the key and the pusher plate have an interfitting relationship, so that the key and plate move in unison, and the key has a driving relation to the plate circumferentially.

One of the functions performed by the keying lug of the pusher plate of the patented construction is to act as a sentry to block the entryway of the lock to a key not having a matching longitudinal groove.

In the present invention, I have discovered that I can construct the key and the pusher plate so that they no longer need have the above described interfitting relationship. The sentry function previously performed by the pusher plate, is now performed by a lug which is provided on an internal plug in the lock.

The key of the present invention has a lug passage slot which not only receives the sentry lug, but the slot is L-shaped and opens up laterally so that after the key is fully inserted, the key can be turned circumferentially to free itself from the lug to enable it to perform its intended functions.

In the prior preferred form of the patented invention, when the key was removed, the pusher plate was free to move a substantial distance, unconstrained except for the contact of its ends with lugs on code discs.

In order to establish alignment of the longitudinal groove of the key with the keying lug on the pusher plate, at the time of insertion of the key, not only was the pusher plate provided with a camming surface, but the end of the key was also provided with a camming surface to facilitate the two to be cammed into proper circumferential alignment.

In the lock and key of the present invention, I have discovered that I can limit the pusher plate's circumferential movement by providing a lug on the plate which is accommodated within a slot on the front interior plug, so that even when the key is removed, the pusher plate has only a limited degree of movement relative to the plug.

I have discovered that with this degree of confinement of the movement of the pusher plate, I need provide a cam surface only on the pusher plate, making it possible to make the end of the key square, thus increasing the capacity of the key insofar as the number of code cuts on it are concerned, or in any event, making the key and thus the lock shorter than would otherwise be the case for the same number of coded cuts.

Another object of the present invention is to provide an improved lock, and an improved lock and key assembly.

Various other objects of the invention will be apparent from the following description taken in connection with the accompanying drawings wherein:

FIG. 1 is a front view of the lock embodying the concepts of the present invention, with the key not yet having been inserted in place;

FIGS. 2 and 3 are longitudinal, sectional views, taken along lines 2—2 and 3—3, respectively, of FIG. 1, but with the key in place;

FIGS. 4 and 5 are vertical cross sectional views taken along lines 4—4 and 5—5, respectively, of FIG. 2;

FIG. 7 is a perspective view of the key;

FIG. 8 is a side elevational view of the key;

FIG. 9 is a plan view of the key; and

FIG. 10 is an end view of the key taken from its free operative end.

DESCRIPTION

Figure 1:
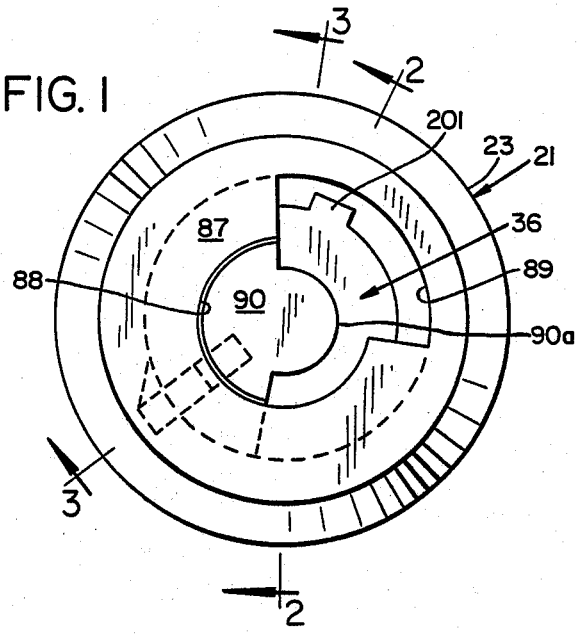
Figure 2:
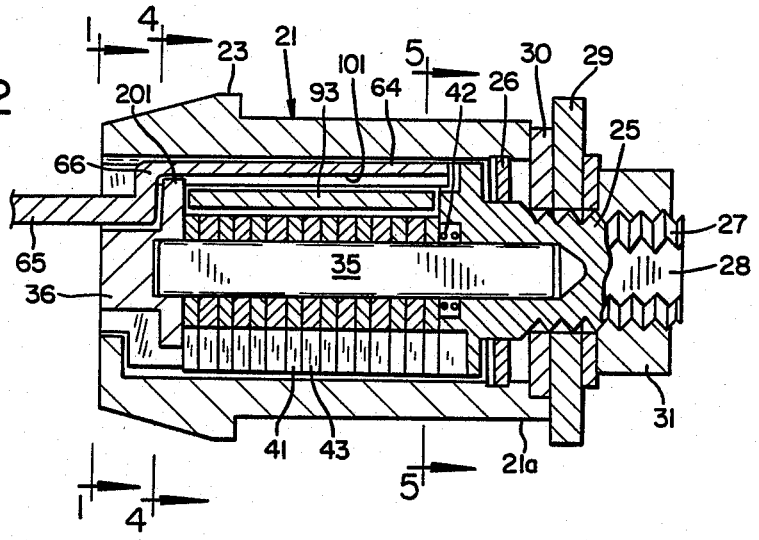

FIGS. 1 and 2 show that the lock comprises a cylindrical housing 21 having an outer flange 23 at its front end. The lock is designed to fit through a non-circular hole provided in a mounting plate (not shown), with the flange abutting the plate. The housing has flats 24 (FIG. 5) to fit the contour of the hole to non-rotatably mount the housing in place. The exterior surface of the rear portion of the housing may be threaded (not shown) so that a nut (not shown), with or without a lock washer, can be used to clamp the housing to the mounting plate. The plate can be the front wall of a key containing safe, or the lock can be mounted in any desired manner.

At the rear portion of the lock, there is a rear plug 25 (FIG. 2) turnably fitting within the housing and retained in place by a snap ring 26. The plug has a rearwardly projecting stub shaft 27, having flats 28 to non-rotatably receive a locking member 29. Interposed between the locking member 29 and the plug is a stop plate 30 which is also non-rotatably received by the shaft 27. A nut 31 clamps both the locking member and the stop plate onto the shaft.

The locking member 29 coacts with an inner surface of a lock receiving structure (not shown), to provide access to the structure when the locking member is in its unlocked position, or to preclude access when the locking member is in its locking position.

The function of the stop plate or member 30 is explained in my prior patent, so the explanation will be brief. Its purpose is to limit the amount of circumferential movement permitted the interior parts of the lock under the influence of the key. It does this by means of a lug 21*a* (FIG. 2) on the housing 21 projecting into a notch formed in the periphery of the stop plate.

The plug 25 has a forwardly projecting shaft 35 which is of square cross section and is non-rotatably received at its rear end by plug 25 and at its forward end by a front plug 36, which turnably fits within the housing 21. Shaft 35 is non-rotatably received within non-circular holes 39 (FIG. 6) provided in a series of actuating discs 41, while the shaft rotatably extends through circular holes 42 provided in code discs 43. A spring 44 (FIG. 2) urges the stack of discs together.

Figure 3:
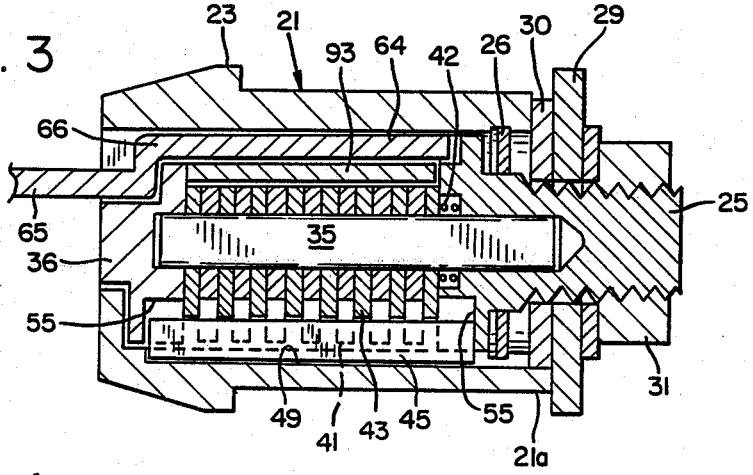
Figure 5:
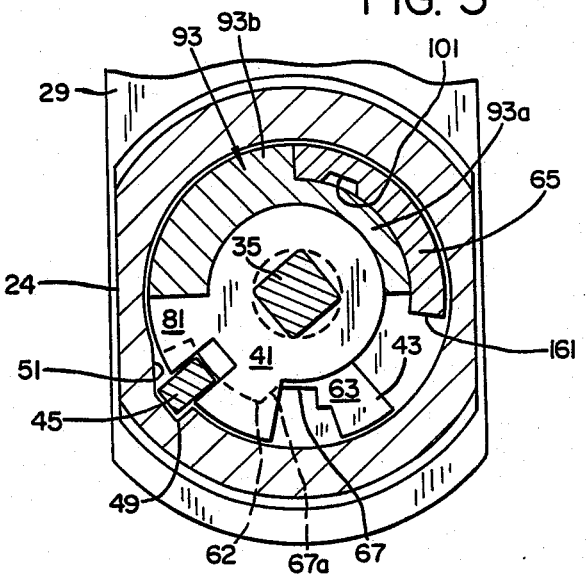
Figure 6A:
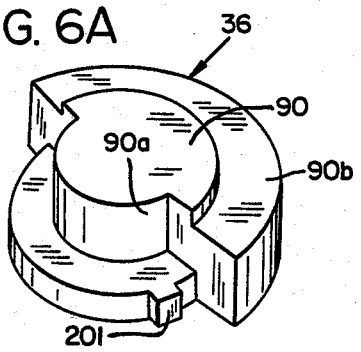
FIG. 6A is a perspective view of the front plug.
Figure 6B:
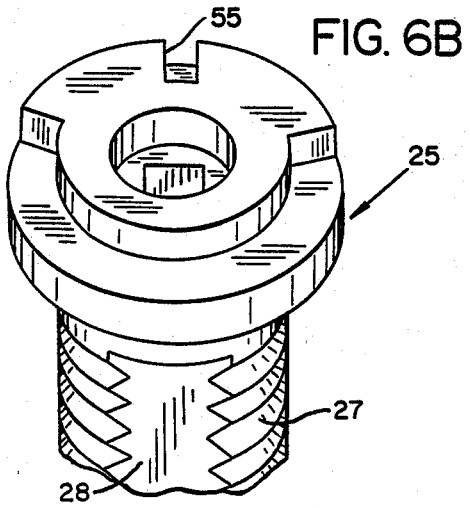
FIG. 6B is a perspective view of the rear plug.

There is a tumbler or latch member 45 (FIGS. 3 and 6), of generally rectangular cross section, whose outer edge fits in a notch 49 (FIGS. 3 and 5). The notch has a ramp 51 to be presently referred to again.

The tumbler slidably fits within notches 55 provided in the plugs 25 and 36 (FIGS. 3, 5, 6, 6A and 6B). The tumbler will be cammed inwardly by forced engagement with the ramp 51, upon clockwise movement of the actuating discs 41, but such inward camming movement will be prohibited by the code discs 43, until the code discs have been moved to predetermined clearance positions (as will be presently described).

The code discs 43, in many respects, are similar in construction to the code discs of the preferred form of the patented construction. Suffice it to say that each has a pair of lugs 63 which flank, and in part define, shoulder 62. A key 65 (FIG. 5) is located in position to contact the nearest lugs 63 of the code discs (which action will be alluded to again, later).

A code notch 67 is formed in the shoulder 62, the notch usually being differently located circumferentially along the associated shoulder on different code discs, depending on the overall code of the lock. Thus typically the code notch of one code disc will be differently disposed than that of an adjacent code disc. That is not mandatory because the overall code sequence might call for the code notch to be similarly located on another coded disc.

The notch 67 is of a size to receive the tumbler 45, as is evident from FIG. 5, but is out of line with the tumbler in the locked condition of the lock. Thus, in the locked condition, the tumbler will rest on or overlie the shoulder 62.

The code discs are of identical construction, except for two differences. First, as above mentioned, the code notches of one disc are usually differently located relative to the lugs 63 from the code notch of an adjacent disc. Second, certain of the discs, preferably the two end code discs, can be considered as "0" position discs, in that the notches 67 are disposed in extreme counterclockwise positions, as is shown in FIG. 5, for the code disc shown. These "0" position code discs are labeled 43*a* (compare FIGS. 5 and 6), and are the ones first contacted by the key and thus are moved circumferentially the greatest extent. The notch of each of such "0" position code disc has its clockwise edge 67*a* inclined so as to form a cam edge. The purpose of these cam edges will be alluded to subsequently. The similar edges of the other code discs are not relieved as are the "0" position code discs.

Figure 6:
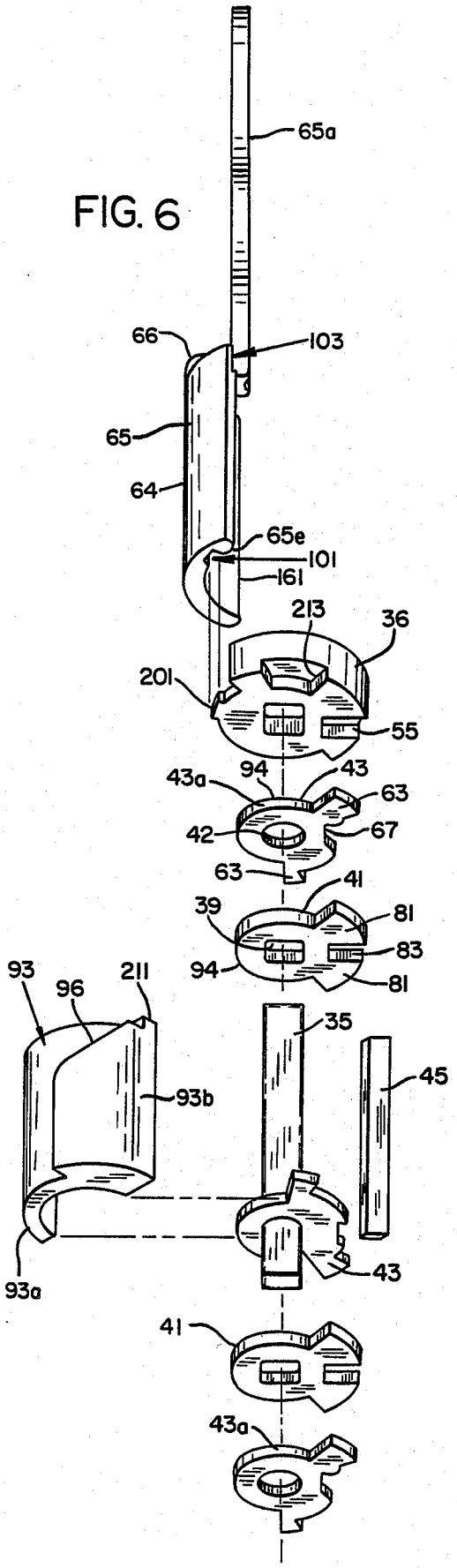
FIG. 6 is an exploded view showing the general relationship of the key to certain internal parts of the lock, with the key being shown in the form prior to the cutting of its bits.

Referring to FIGS. 5 and 6, each of the actuating discs 41 has a pair of lugs 81 defining a deep notch 83 which at all times slidably receives the tumbler 45 (FIG. 5).

Referring to FIGS. 1 and 2, the housing has at its front portion a radially inwardly extending flange 87 in which is formed a circular hole 88, the flange having a notch 89 formed therein to accommodate the key 65, up to and including a dog leg 66 of the key.

The plug 36 has a portion 90 (FIGS. 1 and 6A) projecting forwardly into the hole 88, but being arcuately cut away at 90*a* (FIG. 6A) to leave an inset forward face 90*b*. The cutaway is of sufficient depth that when the key is fully inserted, the dog leg 66 can pass circumferentially behind the flange 87. When the dog leg is so positioned, the flange precludes withdrawal of the key until the key is retro-turned to its initial position in register with the notch 89.

FIGS. 2 and 5 show a curved sector-like anti-pick pusher plate 93 which is cut away to provide a thin portion 93*a* underlying the key 65, and overlying and concentric with the inner curved edges 94 of the discs 41 and 43. The thicker portion 93*b* of the pusher plate is slidably and concentrically received between the inner surface of the housing 21 and the edges 94 of the discs.

The thicker portion 93*b* is formed with a cam surface 96 (FIG. 6) to be engaged by the trailing corner 65*e* of an operating portion 64 of the key, as the key is inserted into the lock. This action deflects the pusher plate sideways, should it be in an entrance-barring position, at the time that the key is inserted into the lock. The action also establishes an operating relationship between the operating portion of the key and the pusher plate.

Referring to FIGS. 7–10, the key has a handle portion 65*a*, a shank portion 65*b*, the dog leg 66, and the operating portion 64.

The operating portion is formed on its inner curved face with an L-shaped groove or slot, having a longitudinal lug-passage groove 101, and a lateral lug-passage groove 103. Groove 101 is defined by sidewalls 105 and 107, a bottom wall 109, and an end wall defined by the inner face 121 of the dog leg 66. Thus, groove 101 is longitudinally blind at its inner end, except for the lateral exit 103.

The lateral lug passage groove 103 is defined by a bottom wall 123, the face 121 at one side, and a short wall 125 at its opposite side. The lateral lug passage groove stops at the wall 107 and thus is blind at its inner end, except for its communication with the groove 101. The bottom wall 123 is of arcuate configuration, being concentric with the axis of the lock, for a reason to presently appear.

The L-shaped groove defines a land 127 which is a continuation of the inner curved face 64' of the operating portion 64 of the key. As is evident from FIGS. 4 and 10, the inner face and the outer face 64'' of the operating portion 64 are concentric about the central axis of the lock.

The shank 65*b* has a central inner face portion 141 which is concentric with the main axis of the lock, such curved portion being flanked by land portions 143. The side edges 145 of the shank portion are parallel to one another and merge into parallel side edges 151 of the dog leg 66. It is evident by the just described construction, that the shank portion, including the vertical portion of the dog leg, is narrower and thus offset from the broader width of the operating portion 64 of the key (FIG. 7).

The key 65 in its blank form (See FIG. 6) is provided with an operating edge 161 which faces circumferentially, and into which cuts are made to provide bits, seven bits 171, 172, 173, 174, 175, 176 and 177 being shown in FIGS. 7–9 by way of example.

While bits 171, 173, 175 and 177 are wider (in an axial direction) than the other bits, all could be made of the same width. However, preferably, they are formed as shown so that the projecting bits will have substantial width for strength purposes.

The front plug 36 is provided with a sentry lug 201 (FIGS. 1 and 6) which guards the entryway of the lock. It is of a size to slidably receive the lug-passage groove 101 and thus permit insertion of the key into the lock. The lug is also of a size, depthwise, to permit the lug, once the key is fully inserted, to pass circumferentially through the lateral lug-passage groove 103 of the key to free the key away from the lug and to permit further turning movement of the key.

Note that the curved operating portion 64 of the key is slidably confined (FIGS. 1 and 3) between the opposed inner curved surface of the housing 21, and the exterior curved surface portions 36*a* and 25*a* of the front and rear plugs. This maintains alignment of the key with the axis of the lock, during turning movement of the key.

When the key is inserted into the lock, its blunt square end 65*c* is intended to engage the cam surface 96 of the pusher plate 93. To insure that the pusher plate will be properly circumferentially disposed at this time, the plate has a forwardly directed lug 211 (FIG. 6), which, at all times, is confined within an arcuate slot 213 provided on the rear face of the front plug 36. This maintains the cam surface 96 in position to be engaged by the corner 65*e* of the key 65, regardless of the position of the pusher plate. The lug 211 also, at all times, maintains the pusher plate in an anti-picking position, barring access of a pick to the rear edges of the discs.

OPERATION

Figure 4:
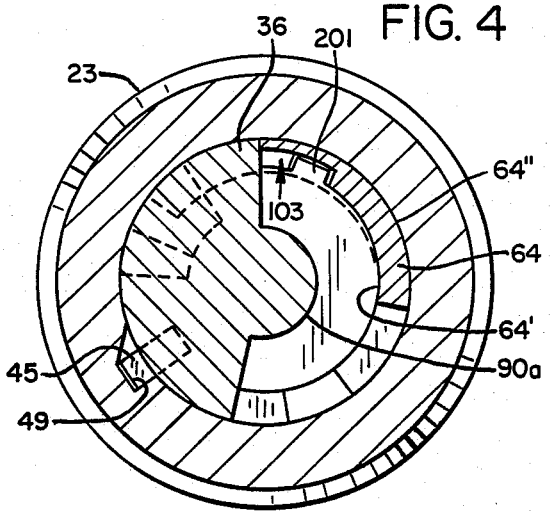

The key 65 is inserted into the lock, with the key pushing the pusher plate aside if it is in the way, until the key is fully inserted, with the sentry lug 201 sliding along the groove 101. This position of the parts is shown in FIGS. 2 and 4. The key is now moved or turned clockwise, with the sentry lug 201 sliding in a curved path through the curved lateral groove 103 (FIG. 4) in the key so as to leave the lug behind.

The clockwise movement is continued to bring the bits of the key 65 into successive engagement with the lugs 63 of the code discs 43 (FIGS. 4 and 7). Such movement will turn the discs 43 coded distances so as to bring the notches 67 therein into alignment with the tumbler 45.

Still further movement of the key applies, by contact of the key against the lugs 81 of the actuator discs, a circumferential force to the tumbler 45, camming it radially inwardly into the notches 67, to unlatch it. Now the key is further turned, moving all of the interior components as a unit, including the pusher plate, because its lug 211 has reached the end of its free play relative to the front plug. Movement of the interior components, acting through the shaft 35, turns the locking member 29 until such movement is stopped by the engagement of the stop lug 21*a* with an edge of the notch in the stop plate 30. The purposes for which the lock was unlocked are now carried out.

To relock the lock, the key is turned counterclockwise to engage the pusher plate and push it around until it engages the farthest disposed lugs 63 (those of the "0" position code discs). Continued retro movement of the key causes the entire interior assembly to move around back to a position just prior to that in FIG. 5, where the stop lug 21*a* engages the opposite edge of the notch in the stop plate 30 to stop movement of the shaft 35 and all parts keyed to it (and leave the locking member 29 in its locked position). Continued retro movement of the key, by applying a turning force to the "0" position code discs, causes the camming edges 67*a* of the code discs to cam the tumbler 45 back into the notch 49. Further clockwise movement of the key and pusher plate will successively apply pressure to the circumferentially trailing edges of the various other code discs to move all of the code discs back to their initial coded positions, thus resetting them (and bringing the parts to the positions shown in FIG. 5, where the key can now be withdrawn).

The key of the present invention is unique in a number of respects. One of its unique features is that not only must the key groove match the height and width of lug 201, but also the depth of the lug. If the lug is too deep, while the lug can pass along the longitudinal leg of the key groove, as the key is inserted, it cannot pass laterally to free the key from the lug. Thus, the lug and groove relationship has a size requirement in three dimensions, the x, y and z axes.

The above unique feature of the key means that the lug and groove relationship between the groove on the key and the lug 201 assure that the key cannot be turned before the key is fully inserted. Turning before that time would cause a hang up of the key bits on the front flange of the lock housing. A similar hang up could occur if the key were rotated while being removed. Thus the lug keeps the key from turning until the proper time, a function added to that of the sentry purposes of the lug.

A unique relationship of the lock and key is that although the key does not have a keyed interfitted relation with the pusher plate, it nevertheless is constrained against unacceptable lateral play by its concentric surface interfit between the interior curved surface of the housing 21, on the one hand, and the exterior curved surfaces of the pusher plate and the exterior curved surfaces of inwardly adjacent portions of the plugs 25 and 36, on the other.

What is claimed is:

1. A peripheral key for a tumbler lock comprising an elongated body member having curved portions for peripheral contact with curved portions of the lock, said elongated body including a handle portion and an operating portion connected together by a dog leg or stepped portion, said operating portion having an outer end remote from said dog leg and an inner end terminating at said dog leg, said operating portion having concentric inner and outer curved faces, said inner face having a longitudinally extending groove formed therein having an open end at the outer end of said operating portion for entry of a sentry lug on the lock and passage of said lug, relatively speaking, along said groove, said groove being defined in part by two side walls and a bottom wall, said inner curved face being formed, at the end of the groove closest the dog leg, with a transverse circumferentially extending arcuate groove communicating with the just mentioned end said lug passage groove, said transverse groove having a blind end located at the inner end of said lug passage groove and an open end remote therefrom to permit escape of the sentry lug from said key retaining groove, said blind end of said transverse groove being defined by the side wall of said longitudinal groove that is remote from the open end of said key retaining groove.

2. A key as recited in claim 1 in which said longitudinally extending groove extends the full length of said operating portion and terminates at said dog leg or stepped portion.

3. A key as recited in claim 2 in which the floor of said transverse groove is concentric with the faces of said operating portion.

4. A key as recited in claim 1 in which the free end of said operating portion is square.

5. A key as recited in claim 1 in which the dog leg or stepped portion has side edges which are parallel to one another.

6. A lock having a housing and plural discs releasably locked against movement relative to the housing by a locking member, rotary plug means within said housing supporting said plural discs, said rotary plug means and discs at least in part defining with the interior of said housing an annular space to receive a peripheral key, a curved pusher plate in said space freely movable relative to said key, means interconnecting said pusher plate with said rotary plug means to permit limited movement only of said pusher plate relative to said plug means, thereby to permit said key to move said pusher plate relative to said rotary plug means a limited extent.

7. A lock as recited in claim 6 in which said rotary plug means provides a sentry lug projecting toward the interior of said housing and blocking access to said annular space by any key except one matching the contour of said sentry lug.

8. A lock as recited in claim 6 in which the pusher plate has at least a portion underlying a portion of the key when the key is inserted into the lock.

9. A lock as recited in claim 7 in which said rotary plug means includes a forward plug and a rearward plug, said forward plug carrying said sentry lug, said interconnecting means comprising a slotted portion on said forward plug and a lug on said pusher plate received by said slotted portion.

10. A lock having a housing and plural discs releasably locked against movement relative to the housing by a locking member, rotary plug means within said housing supporting said plural discs, said rotary plug means and discs at least in part defining with the interior of said housing an annular space, a peripheral key to be inserted into said space, said plug means having a radially outwardly projecting lug, said key having curved inner and outer faces, said inner face having a longitudinally extending groove to accept said lug to permit said key to be inserted into said annular space, said longitudinal groove having at one end a laterally extending groove of a size to pass said lug when the lug reaches the end of said longitudinal groove to prohibit turning of said key until alignment register of said lug with said lateral groove.

* * * * *